US005564568A

United States Patent [19]

Rankin, Sr.

[11] Patent Number: 5,564,568

[45] Date of Patent: Oct. 15, 1996

[54] INSULATING COVER FOR KEG BEER

[76] Inventor: Pleasant P. Rankin, Sr., R.R. 1, Box 375, Tunas, Mo. 65764

[21] Appl. No.: 301,655

[22] Filed: Sep. 7, 1994

[51] Int. Cl.[6] ..... B65D 81/18

[52] U.S. Cl. ..... 206/446; 62/372; 220/4.28; 220/412; 220/754

[58] Field of Search ..... D9/416; 62/372; 206/427,446, 459.5; 215/12.1, 13.1; 220/4.04, 4.08, 4.09, 4.16, 4.28, 411–413, 426, 429, 434, 754, 903; 383/18, 25, 105, 121

[56] References Cited

U.S. PATENT DOCUMENTS

| | | | |
|---|---|---|---|
| D. 309,861 | 8/1990 | Farrar | D9/416 |
| 4,042,142 | 8/1977 | Ruano | 220/426 |
| 4,071,160 | 1/1978 | Vick | 220/412 |
| 4,242,884 | 1/1981 | Kotschwar | 20/412 |
| 4,633,678 | 1/1987 | Lea et al. | 220/434 |
| 4,699,282 | 10/1987 | Farrar | 206/459.5 |
| 4,759,077 | 7/1988 | Leslie | 383/18 |
| 4,802,344 | 2/1989 | Livingston et al. | 62/372 |
| 5,251,460 | 10/1993 | DeMarco et al. | 220/903 |
| 5,265,440 | 11/1993 | Baker | 220/429 |

*Primary Examiner*—Jimmy G. Foster
*Attorney, Agent, or Firm*—Kokjer, Kircher, Bowman & Johnson

[57] ABSTRACT

An insulating cover for keg beer. The cover consists of a relatively flexible insulating material which substantially surrounds one or more kegs of beer. In a first embodiment the cover closely conforms to a single keg of beer, and thus has a cylindrical shape. Handles are provided on the exterior of the cover for easier manual transport of the keg and cover combination. The insulative properties are sufficient to maintain a relatively constant cool temperature without the use of ice, although multiple-use sealed freeze packs may be placed within the cover. In a further embodiment the cover is sized to fit upon a pallet and enclose up to four kegs. A side wall and top of the cover is openable to remove one or more of the kegs.

11 Claims, 2 Drawing Sheets

INSULATING COVER FOR KEG BEER

BACKGROUND OF THE INVENTION

1. Field of the Invention

The present invention relates in general to apparatus for use with keg beer. In particular, the present invention relates to an insulative cover for one or more kegs of beer to maintain the beer in a chilled state during transport or serving.

2. Description of the Related Art

The dispensing of beer or other beverages from kegs is well known. Keg beer provides an economical method of packaging beer. However, various problems have been associated with this practice.

First, it is typically preferred that the beer remain in a chilled condition, or at least not reach an elevated temperature, at all times for best flavor. However, beer distributors typically do not employ refrigerated trucks to transport the kegs from the central distribution point to the various retail outlets. In warm weather this can result in the beer reaching an elevated temperature and losing the desired flavor. Similarly, in cold weather this poses a risk of causing freezing of the beer, damaging it flavor and possibly damaging the keg itself.

Second, the use of kegs has been especially troublesome for the end user. Full kegs are typically quite heavy, and are difficult to carry manually. Additionally, keeping the tapped keg cool has not been a simple task. It is common for the keg to be placed in a large receptacle (often a trash can) and surrounded with ice. The ice will often melt significantly prior to the keg being emptied, creating water. As the keg is emptied it becomes lighter, and will often float in this water before it is fully emptied. This creates problems in pumping the keg to maintain internal pressure. Additionally, if the receptacle leaks, the water will escape. This is especially troublesome at outdoor events, as it commonly forms mud in the high-traffic area surrounding the keg.

SUMMARY OF THE INVENTION

An object of the present invention is to provide a device to maintain one or more kegs of beer at a relatively constant cool temperature during transport and/or dispensing.

Another object of the present invention is to provide such a device which does not require the use of loose ice.

Yet another object of the invention is to provide such a device which may be easily stored.

A further object of the present invention is to provide such a device which permits easier manual transport of a keg of beer.

These and other objects are achieved by an insulating cover for keg beer. The cover consists of a relatively flexible insulating material which substantially surrounds one or more kegs of beer. In a first embodiment the cover closely conforms to a single keg of beer, and thus has a cylindrical shape. Handles are provided on the exterior of the cover for easier manual transport of the keg and cover combination. The insulative properties are sufficient to maintain a relatively constant cool temperature without the use of ice, although multiple-use sealed freeze packs may be placed within the cover. In a further embodiment the cover is sized to fit upon a pallet and enclose up to four kegs. A side wall and top of the cover is openable to remove one or more of the kegs.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
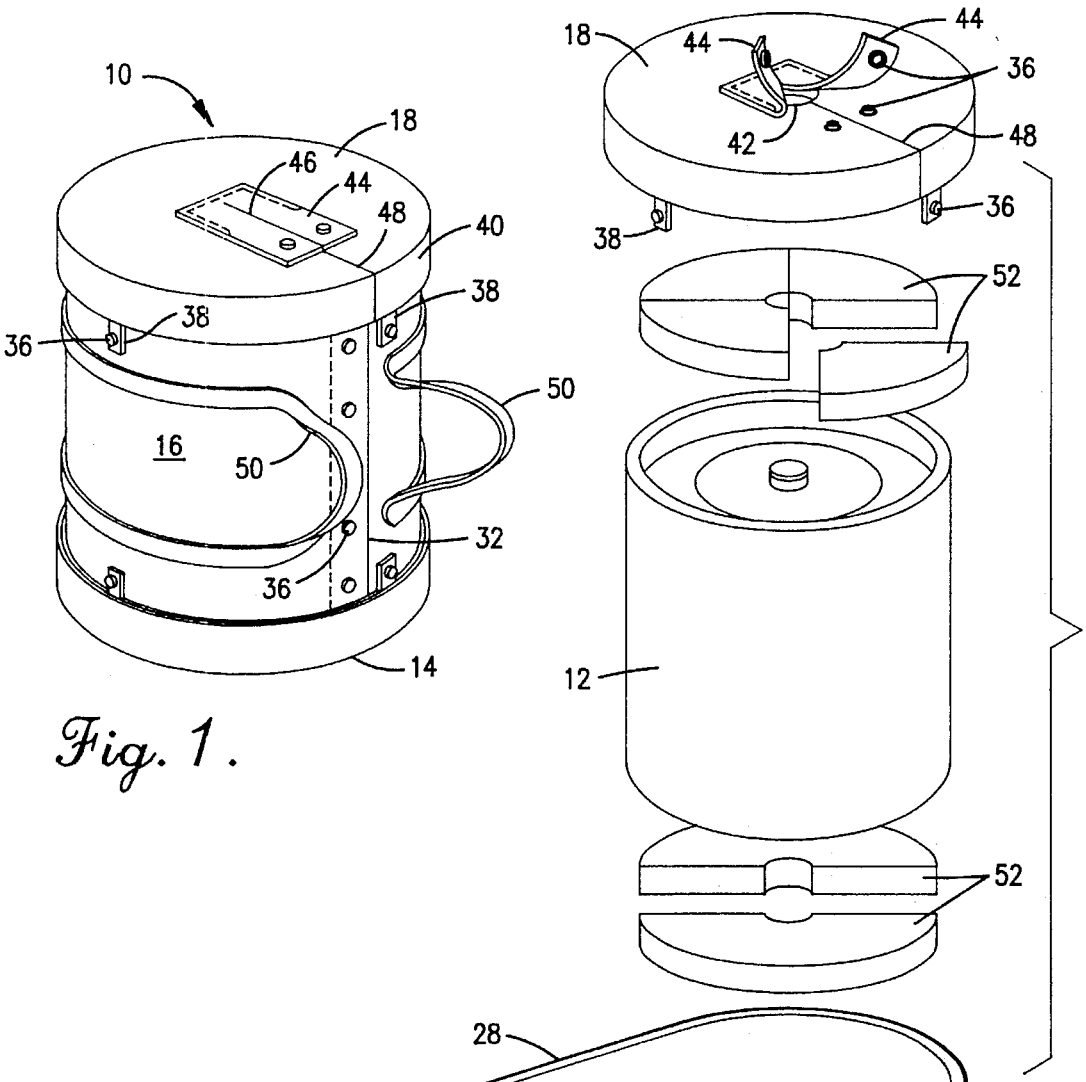
FIG. 1 is a perspective view of a first embodiment of the present invention.
Figure 2:
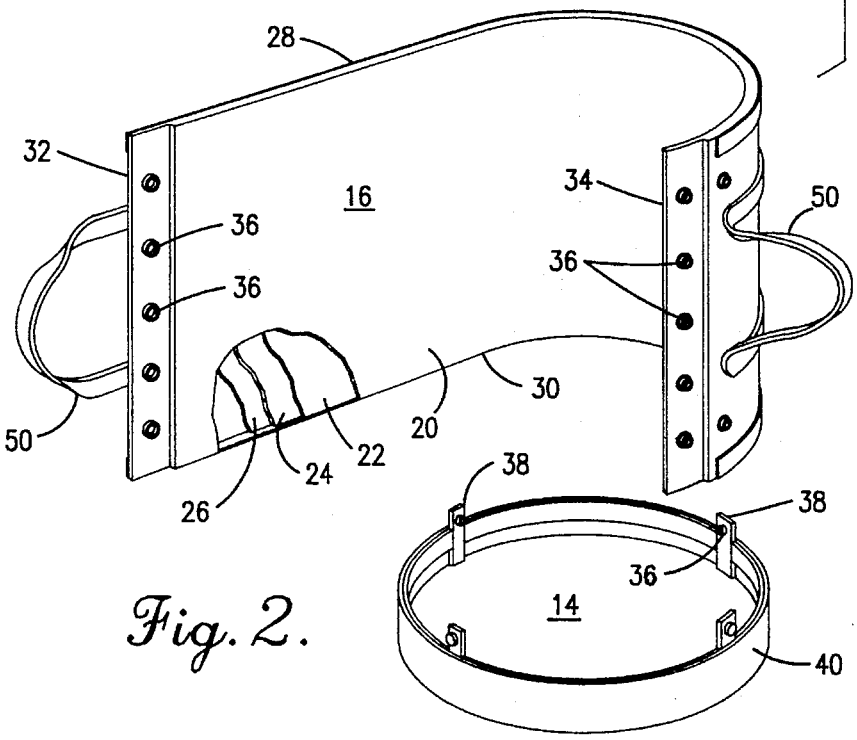
FIG. 2 is an exploded perspective view of the cover of FIG. 1 with a prior art keg.

With reference to FIG. 1, a first embodiment of a cover according to the present invention is generally designated by reference numeral 10. The cover 10 is intended to substantially surround a prior art beer (or other beverage) keg 12 (FIG. 2). The cover therefore has a size and shape generally corresponding to the keg. As there are several standard keg sizes, the cover 10 may of course be provided in several sizes.

The cover 10 includes a bottom 14 upon which the keg 12 will rest. The bottom 14 will have a peripheral configuration corresponding to that of keg 12, which will typically be circular. Extending upward from the outer periphery of the bottom 14 is a sidewall 16. The sidewall 16 will surround the outer periphery of the keg 12. Finally, mounted upon the sidewall is a cap 18. The cap 18 will typically have a size and shape corresponding to that of bottom 14, and as such will typically be circular.

It is preferred that each of the bottom, sidewall and cap be formed of a similar material. This material must be rugged, relatively flexible, waterproof and provide thermal insulation. The thermal insulation should be sufficient to maintain the enclosed keg at a relatively constant temperature. By this, it is meant that the temperature of the keg contents will not vary by an amount sufficient to alter the flavor or quality of the contents, and preferably will not vary by more than one to ten degrees fahrenheit, and most preferably about three degrees fahrenheit, during the normal time of use of the cover. In this embodiment this time of use will be the time typically required to transport the keg from the retailer to the end-use site, and then to dispense the beer from the keg. In later embodiments this time will be that required to transport the beer from the distribution point to the retailer, with intermediate stops. In both cases this time will typically be between one and seven hours, more typically between one and four hours.

One possible arrangement for the material, shown in FIG. 2, is to provide a multi-layer construction having an interior layer 20 of a waterproof material, such as Nomex® fabric, available under the label Neoprene Punch Nomwx® from DuPont. Next, an adjacent layer 22 of a thermal insulating material is provided, such as Armaflux® fabric, available under the label Armaflux II from Armstrong World Ind. of Lancaster, Pa. The next adjacent layer is a second layer 24 of waterproof material, such as Nomex®, as described above. Finally, there is an outer layer 26 of a rugged yet decorative material, preferably being at least partially reflective, such as aluminized Rayon, available from Gentex Corp. of Carbondale, Pa. These layers may be stitched together at their edges, and further stitching may be used to provide a quilted effect, if desired.

As may be envisioned, the waterproof layers will serve as a moisture barrier to keep the thermal insulation dry, the thermal insulation will of course serve its insulating purpose, and the outer layer will provide an aesthetically pleasing appearance. The outer layer, if formed of the desired reflective material above, will also serve to reduce solar heating of the cover and keg. This multi-layer construction is flexible and rugged, and provides excellent thermal insulation.

An alternative arrangement is to provide an innermost layer of plastic sheeting for wear, an adjacent layer of material, such as Q9, available under model no. =Q9 from Southern Mills of Georgia, an adjacent layer of thermal insulation, such as the Armaflux® noted above, and the outer decorative layer, such as the aluminized Rayon noted above.

As is best shown in FIG. 2, the bottom, sidewall and cap of the first embodiment are formed as independent elements which are assembled about the keg. In this regard, the preferred flexible nature of the sidewall will typically require that it be maintained in a tubular configuration. In other words, while the sidewall could be initially be formed as a self-supporting tubular sleeve which is slid over the keg, it is preferred that the sidewall be formed as a strip of material having top and bottom edges 28 and 30 and first and second longitudinal edges 32 and 34. The sidewall may then be secured to the keg by wrapping the sidewall about the keg and releasibly securing the longitudinal ends together. To this end the ends 32 and 34 are provided with appropriate fasteners, such as snaps 36. It should be apparent that other fasteners, such as hook-and-loop fasteners, pressure sensitive adhesives, zippers, buttons, etc. could be employed for in place of the snaps.

The sidewall formed of the preferred materials noted above will be sufficiently flexible to easily wrap about the keg, but is sufficiently rigid that it will remain in place once the longitudinal ends 32 and 34 are secured together. For materials which are not so rigid, it may be necessary to releasibly secure the top edge 28 of the sidewall to the cap 18, such that the cap will support the sidewall. This may be easily effected by various means, such as a tab 38 on one of these elements provided with a releasable fastener for securing the tab to the other of these elements. As above, various fasteners could be employed, such as the snaps 36.

For increased thermal insulation, or to improve aesthetics, the cap 18 may include a peripheral skirt 40. Skirt 40 will extend a distance below the top edge 28 of the sidewall. The skirt 40 may be formed of the same multi-layer material as the remainder of the cover.

The cap 18 includes an opening 42 (FIG. 2) through which a dispensing tap (not shown) may extend when connected to the keg 12. For insulative purposes it is preferred that the opening closely fit about the tap. However, to permit use of the cover with various tap configurations and sizes, the opening may be formed with a size sufficient to receive the largest possible tap, and then be provided with flaps 44.

The flaps 44 will be located on the cover in a position to at least partially obscure the opening 42, with inner edges of the flaps in opposed relation to form a slit 46 (FIG. 1). One end of the flaps will be permanently secured to the cover, with the other end being releasably secured to the cover by appropriate fasteners, such as snaps 36.

When employed with a large diameter tap, the flaps will not be secured with the fasteners, but will be left free to permit the tap to extend through opening 42. With smaller diameter taps, the flaps may be secured with the fasteners to conform about the tap, one on each side with the slit containing the tap. This will serve to improve insulation and aesthetics. While it may be desirable to form the flaps from material having greater flexibility than the remainder of the cover, the flaps could be formed of the same material as the cap.

The cap 18 (including the skirt 40 if used) may also be provided with a similar slit 48. The slit 48 will ease removal and attachment of the cap while the tap is affixed to the keg.

The bottom 14 may be provided with a similar configuration to that of the cap, and in particular be provided with tabs 38 having fasteners 36 and/or a skirt 40. While the tabs and fasteners are of course not required to support the sidewall, they may serve to tension the sidewall, and will in any even serve to prevent accidental removal of the bottom during manual transport. The similarity of design between the cap and the bottom may also ease the use of the cover by first-time users. As with the cap, a skirt formed on the bottom would increase insulation, as well as providing aesthetic symmetry and improved resistance to leaking of accumulated condensation.

To ease the manual transport of the cover and keg, the cover is further provided with at least one handle 48. In the first embodiment two handles are formed using an endless loop of webbing, such that the webbing is secured to the cover along the central portion of the elongated sidewall, parallel to the top and bottom edges, and the handles are located adjacent the longitudinal ends. In this manner the assembled cover and keg may be carried with the longitudinal axis of the keg parallel to the ground, with the web supporting the weight of the keg and the handles serving to draw the longitudinal ends of the sidewall together. Other handle arrangements are of course possible. Other variations may also be made, such as padding the handles.

The cover described above will provide excellent thermal insulation. The formation of the cover elements as separate members allows easy assembly of the cover about the keg. Additionally, it permits easier manual transport of the keg. As such, application of the cover to the keg at the point of pick-up will allow the user to more easily move the keg to its final location, and will maintain the keg at a relatively constant temperature. Furthermore, the relatively flexible nature of the material permits the cover to be rolled or folded into a small volume when not in use, saving storage space.

Depending upon the fit, materials employed, etc., the insulative properties of the cover 10 may be considered insufficient. If this is the case, there may be provided one or more reusable cooling elements 52. These elements will take the form of closed plastic volumes filled with water or other solutions. These elements may then be placed in a freezer prior to use, freezing the enclosed water. When the cover is placed on the keg, these frozen elements may be placed between the keg and the cover, thus serving to reduce or maintain the temperature of the keg.

These cooling elements may take various forms, but it is preferred that they be formed as sections of a circle or annulus, as shown in FIG. 2, for placement above and/or below the keg. The circular configuration of the assembled elements will fit within the typical outer flanges on prior art kegs, and will thus not reduce the kinematic stability of the keg. By forming the elements as segments of a circle or annulus, as opposed to a full circle, their size is reduced and they are easier to fit within a freezer. Additionally, this segmenting also allows easier placement and removal upon a keg which has a tap affixed. As should be apparent, the elements used for the top of the keg must include or form an appropriate opening through which the tap will pass.

Figure 3:
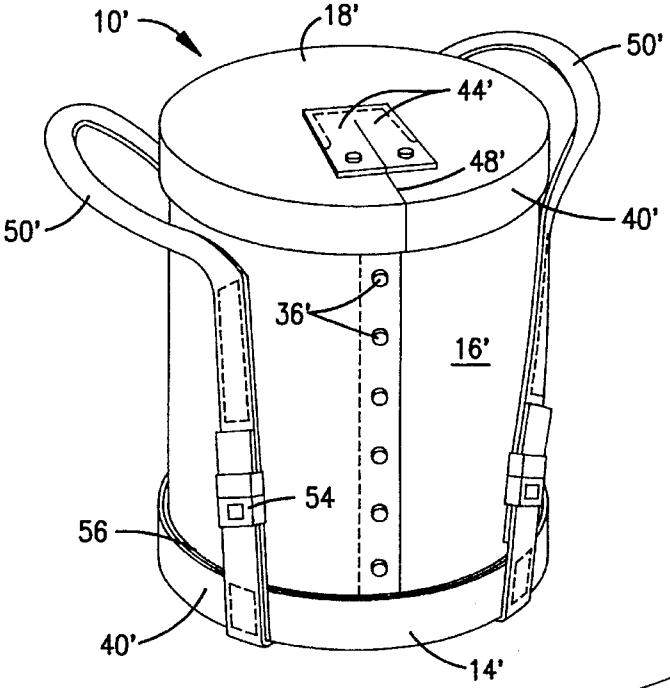
FIG. 3 is a perspective view of a second embodiment of the present invention.

With reference to FIG. 3, a second embodiment of the invention is shown. This cover 10' is similar to the first in many respects, and includes a bottom 14', sidewall 16' and cap 18', etc.

The main difference between the first and second embodiments is the handle arrangement. In particular, in this embodiment each handle 50' is formed as a portion of a separate endless loop. A portion of each loop extends across a chord of the bottom 14, such that the loop will serve to support the keg when carried. This arrangement of course allows the keg to be carried upright, and is well suited for permitting two persons to share the load of the keg.

As noted above, it may be preferred to form the bottom and the sidewall separable, as this may allow the cover to be more easily applied to the keg. If this is the case, the loop forming the handles may be permanently secured to the lower face of the bottom, but not secured (or at least removably secured) to the sidewall, thus permitting the desired separability. As an alternative, the embodiment of FIG. 3 shows the loop secured to both the bottom and the sidewall, but with a separable connector 54, such as a snap buckle, near the junction of the bottom and sidewall. In this manner the connector can be released to permit the bottom and sidewall to be separated, and connected to permit the connector to transmit forces through the loop.

A second variation in this embodiment is the lack of tabs 38 for securing the bottom and cap to the sidewall. In this embodiment hook and loop fasteners 54 are located in the inner periphery of the skirt 40' and the outer peripheries of the top and bottom edges of the sidewall.

Figure 4:
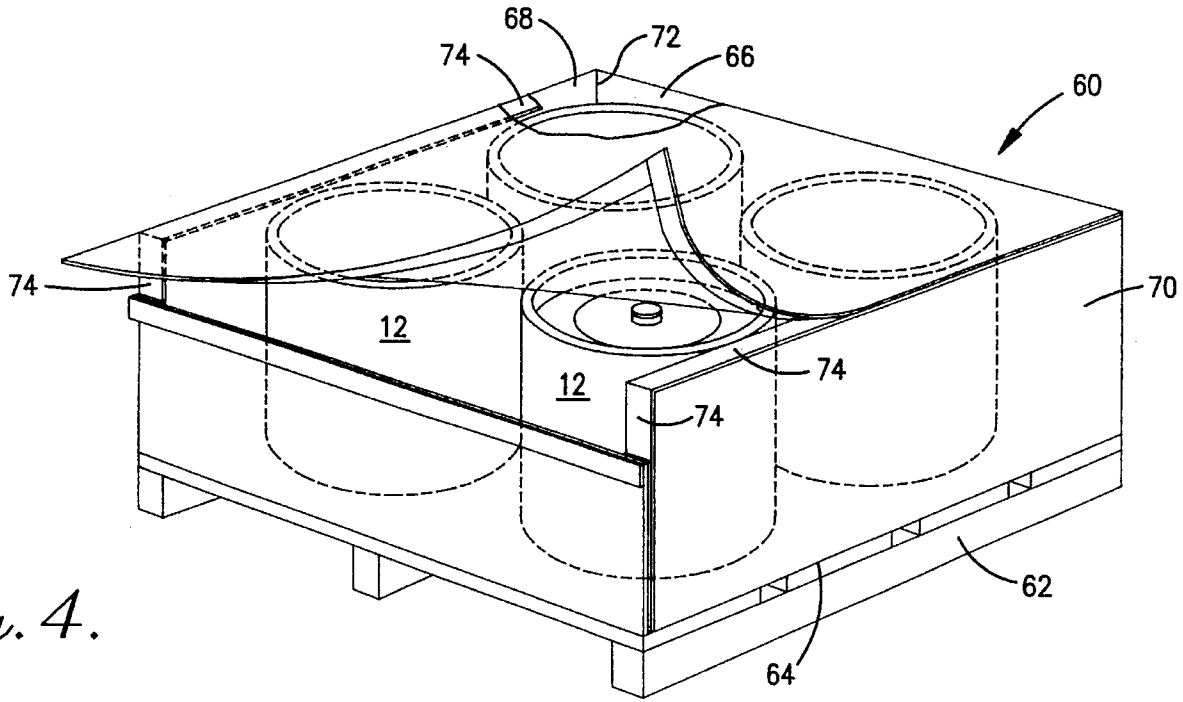
FIG. 4 is a perspective view of a third embodiment of the present invention.

With reference to FIG. 4, a third embodiment of the present invention is shown. In this embodiment a multi-keg cover is generally designated by reference numeral 60. The cover 60 is intended for use in the transport from the distributor to the retailer, where it is common to ship several (typically four) kegs 12 on a single prior art pallet 62. The trucks in which these kegs are shipped are typically not refrigerated, such that the chilled kegs can undergo significant warming on the trip to the retailer, possibly affecting the flavor of the contents.

The cover 60, in a manner similar to the previous covers, provides thermal insulation to maintain the kegs at a relatively constant temperature, and may be formed of the same materials as the first embodiments. The cover 60 will include a generally planar bottom 64 having a size and shape generally corresponding to the loading area of the pallet. In the embodiment shown, the bottom is formed as a square.

Extending upward from the periphery of the bottom are rear, first and second side walls 66, 68, and 70, respectively. These walls are secured together at their common vertical edges, such as at reference numeral 72, to assist in maintaining the walls in a vertical conditio, and thus the cover in a three dimensional form. To further assist in this, and for another purpose described below, the top and front edges (i.e., those not connected to the bottom or the rear wall) of the side walls 68 and 70 are provided with securing flaps 74.

The securing flaps are generally planar strips of material cantilevered from the associated edge of the sidewall. The flaps may be formed from the same material as the remainder of the cover 60, or may be of a more rigid material for support. It is preferred that the ends of the flaps be secured to the adjacent structure, such as the upper edge of the rear wall, the adjacent end of the adjacent flap, or the front peripheral edge of the bottom 64. As may be envisioned, this will serve to support the walls in an upright configuration.

To close the cover 60, there is at least provided a cap 76. The cap 76 is secured to the upper edge of the rear wall 66, and has a size and shape such that it will extend between the side walls and toward the front edge of the bottom 64, with the side edges of the cap resting upon the flaps 74. The cap will typically at least extend to the front edge of the side walls, and preferably extends beyond, such that a portion of the cap will hang downward and form at least a portion of a front wall 78 of the cover 60.

While the cap could extend all the way to the bottom 64 at this front wall, it is preferred it extend only a portion of the way, and that there be provided a front flap 80 to form the remainder of the front wall 78. The front flap 80 is secured to the front edge of the bottom 64 between the side walls, and is movable from an open position hanging downward from the bottom 64 and a closed position releasably secured to the flaps 74. As in the first embodiments, various fasteners could be used to secure the front flap 78 in its closed position, but hook-and-loop fasteners 82 located on the flaps 74 and the side edges of the front flap are preferred.

In a similar manner, the cap 76 may be secured to the flaps 74 by fasteners, again preferably hook-and-loop fasteners 82. To further secure the front flap 80 in its closed position and maintain a constant temperature, the free end of the cap 76 may be releasably secured to the free end of the front flap 80, yet again preferably by hook-and-loop fasteners 82.

With the above arrangement the bottom, cap, front, rear and side walls together form a thermally insulated cavity which will hold the multiple kegs of beer. The user may easily access the cavity by manually pulling upon the cap and lifting it toward the rear. The materials described above are sufficiently flexible that the cap may then be folded back upon itself to remain open. Of course, the cap may be fully lifted prior to folding back, providing greater access to the interior of the cover 60.

In a similar manner the front flap 80 may be manually moved to its open position. This will allow full access to the interior of the cover to permit kegs to be placed in, or removed from, the cover. This arrangement, with its use of quickly released hook-and-loop fasteners, is particularly suited to removing one of the kegs at a time with subsequent reclosing of the cover. This permits optimum insulation of the kegs while a single user transports the kegs from the transport truck to the retailer.

The side walls may have a tendency to fall outward when the cap and front flap are in the open position. However, the materials noted above provide a sufficiently rigid construction that such "sagging" of the side walls is within acceptable limits for ease of operation. It is also noted that opening the cap only partially will serve to reduce such "sagging", as the portion of the cap secured between the side walls will assist in maintaining their proper position.

Various modifications may be made with the cover 60, also. For example, the cap may be provided with multiple openings (not shown) similar to those in the first embodiments, such that the kegs within the cover 60 may be tapped. This would be useful at large events. These opening could be provided with flaps as before, so that the openings could be covered when not in use to better maintain the constant temperature within the cover 60.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A thermally insulative cover for a keg of liquid beverage, such as beer, said cover comprising:

a bottom having a periphery and a size to receive thereon said keg;

a sidewall releasably connected to, and extending upward from, said periphery of said bottom, said sidewall having an upper edge and a height generally corresponding to that of said keg;

a cap releasably secured to an upper edge of said sidewall, said cap, said bottom and said sidewall defining a cavity sized to receive said keg, said cap including an opening extending therethrough through which a tap may pass;

at least one handle secured to said sidewall; and said bottom, said sidewall, and said cap being formed of an at least partially flexible material for thermally insulating said keg.

2. A cover as in claim 1, wherein said cap further includes a pair of flaps secured thereto in closely adjacent relation to define a slit between said flaps, said slit passing across said opening.

3. A cover as in claim 1, wherein said bottom and said cap each include a peripheral skirt formed of said material.

4. A cover as in claim 1, wherein said sidewall is formed as a strip of said material having top and bottom side edges and longitudinal ends, such that when wrapped about said keg said longitudinal ends are brought into contact, and further including means for releasably securing said longitudinal ends together.

5. A cover as in claim 1, wherein said at least one handle forms an endless loop, with a portion of said loop passing across said bottom.

6. A cover as in claim 1, wherein said at least one handle forms an endless loop, with a portion of said loop passing along an angular extent of said sidewall.

7. The cover as set forth in claim 1 wherein said sidewall is constructed of a first interior layer of waterproof material, an adjacent layer of a thermal insulating material, a second layer of waterproof material adjacent said thermal insulating material, and an outer layer of material.

8. The cover as set forth in claim 1, further comprising at least one reusable cooling element, formed of a closed plastic container for receiving a frozen liquid, said container for placement beneath said cap, and within said cavity defined by said sidewall, said cap, and said bottom.

9. A thermally insulative cover for a keg of liquid beverage, said cover comprising:

a bottom having a periphery and a size to receive thereon said keg;

a sidewall releasable connected to, and extending upward from, said periphery of said bottom, said sidewall having an upper edge and a height generally corresponding to that of said keg;

a cap releasably secured to an upper edge of said sidewall, said cap, said bottom, and said sidewall defining a cavity sized to receive said keg, said cap including an opening extending therethrough through which a tap may pass;

at least one handle secured to said bottom; and said bottom, said sidewall, and said cap being formed of an at least partially flexible material for thermally insulating said keg.

10. The cover as set forth in claim 9 wherein said bottom has a lower face and said at least one handle is permanently secured to said lower face of said bottom.

11. The cover as set forth in claim 10 wherein said at least one handle is also removably secured to said sidewall.

* * * * *